United States Patent [19]

Abel

[11] 4,005,980

[45] Feb. 1, 1977

[54] SATELLITE TUBE SUPPORT

[75] Inventor: Paul Abel, Ennigerloh, Germany

[73] Assignee: Polysius AG, Neubeckum, Germany

[22] Filed: Sept. 5, 1975

[21] Appl. No.: 610,675

[30] Foreign Application Priority Data

Sept. 19, 1974 Germany ..... 2444817

[52] U.S. Cl. ..... 432/80; 432/3

[51] Int. Cl.[2] ..... F27D 15/02

[58] Field of Search ..... 432/80, 3, 103

[56] References Cited

UNITED STATES PATENTS

| | | | |
|---|---|---|---|
| 3,384,356 | 5/1968 | Durinck | 432/103 X |
| 3,794,462 | 2/1974 | Sylvest | 432/80 |
| 3,840,335 | 10/1974 | Deussner | 432/80 |
| 3,859,039 | 1/1975 | Heinemann et al. | 432/80 |

FOREIGN PATENTS OR APPLICATIONS

| | | | |
|---|---|---|---|
| 1,092,837 | 4/1955 | France | 432/103 |

*Primary Examiner*—John J. Camby

[57] ABSTRACT

This invention relates to a rotary tube for heat exchange between solid material and gas, with satellite cooler tubes uniformly distributed around the periphery of the rotary tube in the vicinity of the exit end thereof, the satellite tubes being supported over at least one longitudinal section by a group of support elements uniformly distributed on the outside of the rotary tube casing.

16 Claims, 9 Drawing Figures

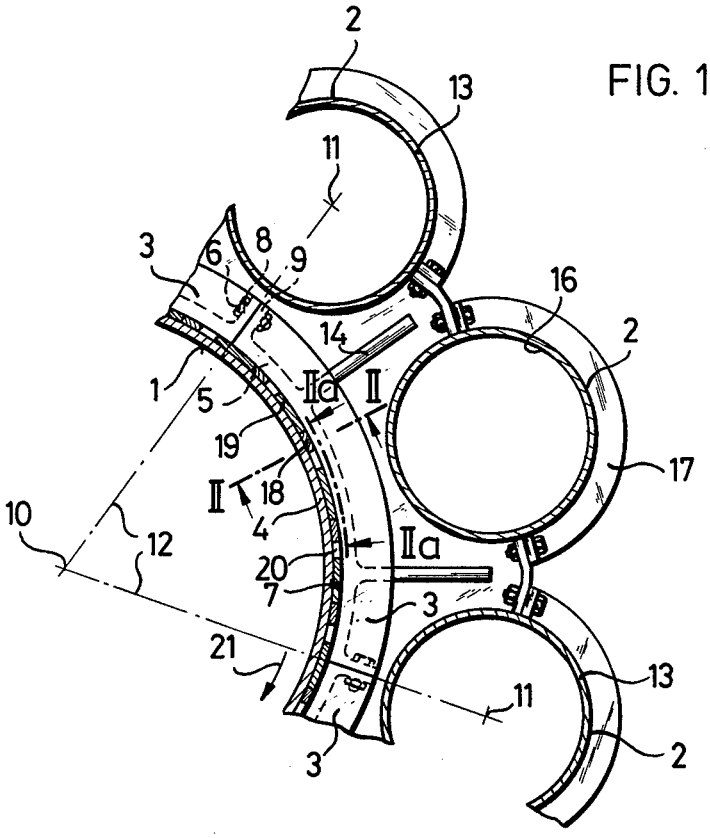
FIG. 1
FIG. 2
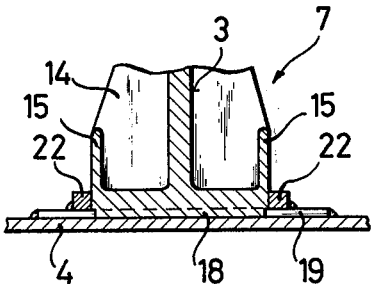
FIG. 4
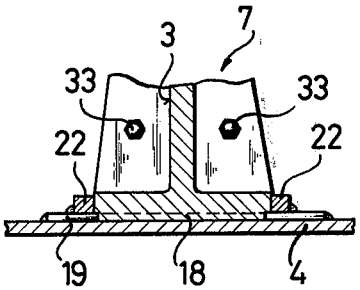

SATELLITE TUBE SUPPORT

A rotary tube of this type can basically form part of a rotary kiln or of a multi-stage rotary tube cooler.

Many constructions of this type are known in practice, and in general the satellite tube support elements and their holding members are welded onto the exterior of the rotary tube casing. Various difficulties arise with these known constructions. For example the support elements are subjected to very large forces during the rotation of the rotary tube which are transmitted to the rotary tube casing where the face tends to deform the rotary tube and often causes splitting of the rotary tube casing in the vicinity of the weld points. Further, because the support elements project generally radially from the rotary tube casing, which is in any case already of considerable size, difficulties can arise in transporting the assembly to the installation site.

An object of the invention is to provide a rotary tube of the type described, wherein the satellite cooler tubes can be mounted on the rotary tube casing by relatively simple constructional means with the forces arising from the satellite cooler tube loads being distributed in such manner that the deformations of the rotary tube casing attributable to such loads can be largely prevented.

According to the invention this problem is in general solved in that the support elements of a group have their radially inner surfaces which contact the rotary tube casing formed as circular segments, and the support elements belonging to a group can be joined with each other to form a continuous support ring surrounding the rotary tube casing and closely fitting thereto.

With the construction provided by the invention, the support elements holding the satellite cooler tubes are combined into a support ring, and there is a greater ease of assembly as compared with the known constructions referred to earlier. Thus when the support ring has been formed from the individual support elements and closely fitted to the rotary tube casing, there is no need for the individual support elements to be welded to the rotary tube casing. In the production workshop the individual support elements need only be matched to the rotary tube casing and need not then be applied to the casing until the rotary tube is installed in situ. This also means that transport of the rotary tube is made easier.

The interconnected support elements in a group form a relatively stiff and stable support ring, so that in particular the load forces derived from whichever satellite cooler tubes are at the side of the rotary tube are first largely distributed to the support ring. This, therefore, also acts as a species of stiffening ring for the rotary tube casing in that area, so that deformations of the casing as a result of those load forces is largely avoided. As compared with known constructions, the wall thickness of the rotary tube casing can if desired be reduced accordingly, which may lead to a considerable saving of material costs.

According to one aspect of the invention, it is particularly advantageous if the support ring formed by the circular sectors of the support elements has peripherally spaced radial projections on its inner peripheral side, with corresponding projections on the outside surface of the rotary tube casing which carries the support elements, so that the inwardly directed projections from the support ring engage in spline fashion in the gaps between the outwardly directed projections from the rotary tube casing.

When with the construction provided by the invention the adjacent support elements in a support ring are releasably connected together by bolts, on the one hand it is possible to have simple and rapid assembly of the individual support elements, and on the other hand it is possible for the support elements to be disassembled equally simply and rapidly in case of need.

With the rotary tube in accordance with the invention the support elements can be so designed that a support ring includes a support element for each satellite cooler tube, or that the support element in a ring is adapted to support or hold two or more satellite cooler tubes.

In general, satellite cooler tubes are held by support elements at two longitudinally spaced areas; firstly in the area of the material inlet end of a satellite cooler tube this tube is firmly held against the rotary tube in the radial and peripheral directions and is also fixed in the axial direction (known as fixed support), while in the area of its outlet end of a satellite cooler tube is generally held fast in the peripheral direction of the rotary tube, but can move in the radial and axial directions (known as loose support), so that thermal expansion of the satellite cooler tubes can be largely absorbed without stress. In corresponding manner the satellite cooler tubes with the rotary tube provided by the invention can also be supported at two longitudinally separated areas by support rings composed of individual support elements. The one support ring consists only of support elements which firmly engage the individual satellite cooler tubes, while the other support ring consists only of support elements which loosely engage the individual satellite cooler tubes and hence permit a corresponding mobility in the cooler tubes.

Some embodiments of the invention are described in more detail below with reference to the drawings, wherein:

FIG. 1 is a partial cross-section through a rotary tube fitted with satellite cooler tubes, in accordance with the invention;

Figure 2A:
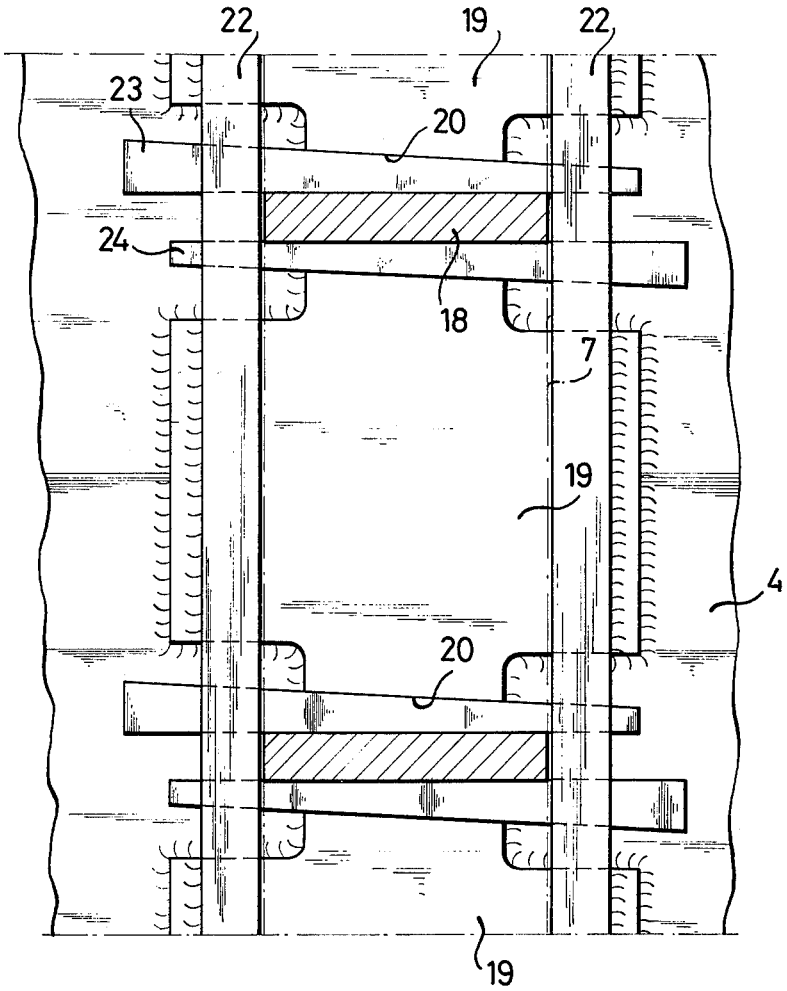
FIG. 2 is a section on the line II—II in FIG. 1.
Figure 3:
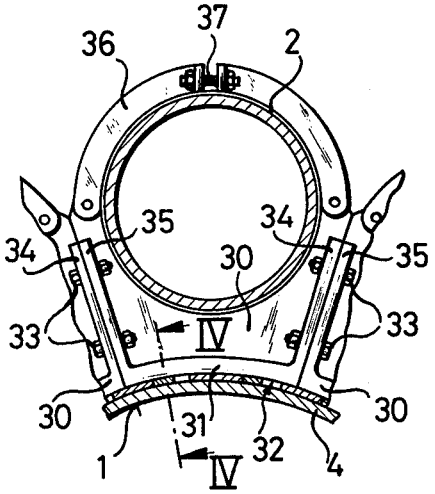
Figure 5:
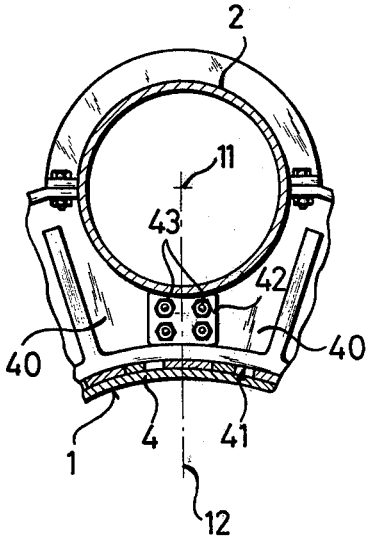
Figure 6:
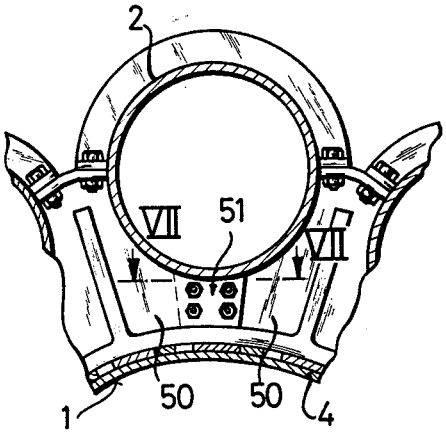
Figure 7:
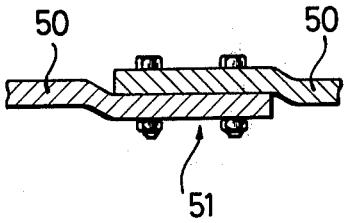

FIG. 2*a* is a partial section on the line II*a*—II*a* in FIG. 1;

FIG. 3 is a partial cross-section, similar to FIG. 1, through a second embodiment of the invention;

FIG. 4 is a sectional view on the line IV—IV in FIG. 3;

FIGS. 5 and 6 are two partial cross-sections, similar to FIG. 1, of two further embodiments of the invention;

FIG. 7 is a detailed sectional view on the line VII—VII in FIG. 6; and

Figure 8:
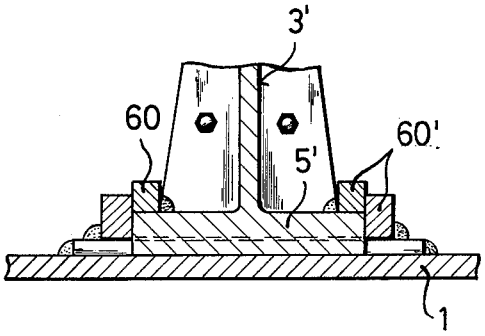

FIG. 8 is a sectional view, similar to FIG. 4, of a further embodiment of the invention.

In the embodiments as shown in the drawings of rotary tube constructions in accordance with the invention, a desired number of satellite cooler tubes are distributed uniformly around the periphery of the exit end of the rotary tube in a rotary kiln. To enable the principle of the invention to be shown more clearly, for each of the embodiments only one or at most a few satellite cooler tubes are shown, together with part of the rotary tube cross-section, on an enlarged scale.

FIGS. 1–2*a* show a first embodiment of the invention. In this case the rotary tube 1 is cut through transversely at a section of the length in whose vicinity are located the exit ends of the satellite cooler tubes 2. These satellite cooler tubes 2, are uniformly distributed round the periphery of the rotary tube and are held by support elements 3, also uniformly distributed round the rotary tube periphery, applied to the outside of the rotary tube casing 4 and assembled into a group.

At their inner portions in contact with the rotary tube casing 4 the support elements 3 are formed as circular sectors 5. As may be clearly seen, support elements 3 which are adjacent in the peripheral direction of the rotary tube 1 are releasably connected together by bolts 6 in such manner that the circular sectors 5 of all the support elements 3 belonging to that group are combined into a support ring 7 which surrounds the rotary tube casing 4 and is matingly fitted thereto.

The bolts 6 which hold together the adjacent support elements 3 and hence the support ring 7 are inserted through flange-like projections 8, 9 on the facing side portions of adjacent support elements 3, which have appropriate holes. The adjacent support elements 3 of the support ring 7 are in this case provided in the area of the radial planes 12 which intersect the centre 10 of the rotary tube 1 and the centres 11 of the corresponding satellite cooler tubes 2 and between the cooler tube casings 13 and the rotary tube casing 4.

In principle a support element can be so formed that it serves to hold a single satellite cooler tube or a number of adjacent satellite cooler tubes. With the embodiment shown in FIG. 1 the support elements 3 are designed to hold or support two complete satellite cooler tubes 2, whereby one satellite cooler tube (the centre one of the three visible) is completely held by one support element 3, while two other satellite cooler tubes 2 are only half supported, the other half in each case being held by the neighboring support element. Obviously the support elements 3 could instead be designed so that — as will be explained for another example — they each supported only whole satellite cooler tubes. As far as the construction of the support elements 3 is concerned, these can be made either by welding or by casting. The choice of manufacturing method will depend on the particular circumstances; as a rule manufacture as a casting will be preferred. For reasons of strength it is also generally desirable to provide a reinforcing rib 14 on the support elements 3 between the satellite cooler tubes 2, the rib extending generally radially of the rotary tube 1 and projecting in a generally axial direction.

As may be seen especially from FIGS. 1 and 2, the circular sectors 5 of the individual support elements 3 also have lateral reinforcing webs 15, which at the same time form annular edge boundary webs for the support elements and the support ring 7 formed therefrom.

As may also be clearly seen from FIG. 1, the support elements 3 for each satellite cooler tube have a generally circular aperture 16, defined by a semi-circular recess in the support element, the corresponding inner part and a semi-circular holding element 17 which is fixedly bolted to the support element. Since, as already indicated above, the support ring 7 formed from the support elements 3 is in the area of the exit ends of the satellite cooler tubes 2, the individual support elements 3 are intended for loose support of the satellite cooler tubes 2, i.e. the individual satellite tubes 2 are enclosed by the corresponding support elements 3 so that said tubes can slide axially through the circular opening, as the tube undergoes thermal expansion.

In order to be able to provide a close fit of the support ring 7 against the rotary tube casing 4, the inner peripheral side of the support ring 7 has tabs or projections 18 projecting inwardly and spaced around the periphery, while on its peripheral outer side carrying the support elements 3 and support ring 7, the rotary tube casing 4 also has peripherally spaced apart and generally radially outwardly directed projections 19; the projections 18 on the support ring then engage in spline fashion in the gaps 20 formed between the projections 19 on the rotary tube casing 4. When The rotary tube 1 rotates in the direction of arrow 21, the support ring 7 can then be positively entrained by the rotary tube casing, so that the satellite cooler tubes 2 move in the same manner as the rotary tube 1. In order to secure the support ring 7 in the axial direction, the two axial end faces of the support ring 7 are preferably each provided with a limiting ring 22 fixedly attached to the rotary tube casing 4, (see FIG. 2).

FIG. 2*a* shows a view of a detail which reveals how to close fitting application of the support ring 7 to the rotary tube casing 4 can be particularly reliable. Here the outwardly directed projections 19 on the outside of the rotary tube casing 4 constitute a species of support plate for the support ring 7, merely indicated here, and for the limiting rings 22. As may be clearly seen, the inwardly pointing radial projections 18 from the support ring 7 engage in the gaps 20 of peripherally adjacent support plates 19; the gaps 20 are made big enough for wedges 23, 24 on both sides (in the peripheral direction) of the support ring projections 18 to be drivable in from opposite directions, and hence while abutted against the corresponding support plates 19 to fix in position the support ring projections.

A somewhat modified embodiment of the invention is shown in FIG. 3, where parts identical with those in the preceding example bear the same reference numbers. In this case support elements 30 are disposed on the outer periphery of the casing of the rotary tube 1, and their inner portions in contact with the rotary tube casing 4 are again formed as circular sectors 31 — again in this case these circular ring sectors 31 of the support element 30 are joined together in a support ring 32 in the manner described above.

In contrast to the preceding example, each support element 30 is adapted to hold single satellite cooler tube 2. The support elements 30 of the support ring 32 which are adjacent each other in the peripheral direction of the rotary tube 1 are joined together by bolts 32 in the area between two adjacent satellite cooler tubes 2, the bolts being inserted through flange-like structures 34, 35 on the adjacent side portions of neighboring support elements 30. The flange-like structures 34 and 35 provide very large abutting surfaces and also a very secure bolted joint.

In this embodiment the circular sectors 31 are again quite simply designed, since as FIG. 4 shows, they are made without lateral reinforcing webs such as in FIGS. 1 and 2. The close fit of the support ring 32 on the rotary tube casing 4 can however be provided in the same manner as described for FIGS. 1 to 2*a*.

While in the first embodiment the support elements and the support ring were intended for axially movable support of the satellite cooler tubes 2 in the area of their exit ends, the support elements 30 and the support ring 32 in the embodiment shown in FIG. 3 are used to support the satellite cooler tubes in the area of their inlet ends, the cooler tubes 2 being fixedly surmounted by the individual support elements 30 (fixed support). In this case the holding element 36 of the bearing element 30 is made in two parts, these two parts being pivotally mounted on the inner part and connected at their centre by a clamping bolt 37, so that the corresponding satellite cooler tubes 2 are firmly clamped upon the support elements 30.

A further embodiment of the invention is shown in FIG. 5 wherein the parts which coincide with similar parts in FIGS. 1–2*a* have the same reference numbers.

This embodiment is very similar to that of FIG. 1, especially in that the satellite cooler tubes 2 are firmly enclosed by the individual support elements 40 in the area of the material inlet ends, and in that the side portions of adjacent support elements 40 of a support ring 41 lie against each other in the area of a plane 12 connecting the centre of the rotary tube 1 and the centre 11 of a satellite cooler tube 12, and between the cooler tube casing 13 and the rotary tube casing 4. In this case however the oppositely disposed side portions of adjacent support elements 40 abut each other, and in order to connect these two side portions there are provided plates 42 which partly overlap the side portions. Bolts 43 are then provided in these plates 42 and the corresponding side portions of the adjacent support elements 40 in order that said elements 40 may be releasably connected together.

In this embodiment the support ring 41 is preferably made in the manner described in relation to FIG. 4, i.e. without lateral reinforcing webs, while the close fitting engagement of the support ring 41 on the outside of the rotary tube casing is again effected in exactly the same manner as was described with relation to the first embodiment (especially FIGS. 1 and 2*a*).

A modification of the embodiment represented by FIG. 5 is shown in FIGS. 6 and 7, where again the same reference numbers are used for parts identical with those in FIGS. 1–2*a*.

While in the FIG. 5 embodiment the adjacent support elements 40 are releasably connected together by separate plates 42 and with the aid of bolts 43, in the example in FIGS. 6 and 7 the support elements 50 which are adjacent each other in the peripheral direction of the rotary tube 1 are bolted to each other at overlaps 51 which as shown especially by FIG. 7 are formed by making the side portions of adjacent support elements 50 with an appropriate crank in them.

All other features of this finally described embodiment may match those of the preceding embodiments.

It will be understood that numerous further variations and modifications of the embodiments described are possible; in particular, it is naturally also possible for the features described and shown for the various embodiments to be appropriately combined with each other in individual cases of necessity.

In any case however an extremely secure support for the satellite cooler tubes can be achieved, at the same time combined with highly favorable distribution of loads and forces on the rotary tube casing. One advantage which should not be overlooked is the considerable simplification of assembly in these embodiments provided by the invention. Finally as regards the mounting of the satellite cooler tubes, a further advantage of the construction in accordance with the invention arises in the case of breakage of a support element. In such instance the entire support ring constituted by the individual support elements can be held together, at least for a certain period, if the outer parts of the support elements over-span the points of separation and hence the satellite cooler tubes.

The rotary tube of a rotary tube cooler with at least two stages can from the constructional aspect be made in similar manner to the rotary tube in a rotary kiln. The first cooling stage could, for example, comprise the rotary tube, with the satellite cooler tubes as the second cooling stage.

In a special method of further ensuring the cohesion of a support ring 7 built up of a group of support elements, a security strip 60, 60′ can be applied to the circular sector 5′ of all the support elements 3′, at the side edges of the support ring 7 as seen in the axial direction of said ring. This is shown in FIG. 8. This strip can comprise for instance steel rings which are of rectangular cross-section (as shown). After the support ring 7 has been assembled, these rings are disposed on the circular sectors 5′ and if necessary fixed in place (e.g. by tack welding). Otherwise the construction and arrangement may be as in FIG. 4.

I claim:

1. In a rotary tube assembly for heat exchange between solid and gas having a plurality of axially extending satellite cooler tubes uniformly distributed around the outer periphery of a rotary tube in the vicinity of the exit end thereof, and supporting means for mounting the satellite tubes on the rotary tube; the improvement wherein said supporting means comprises a plurality of like support elements each constituting one circumferential segment of an annular ring adapted to surround said rotary tube in closely fitting relationship thereto, securing means for detachably securing said support elements to each other to form a continuous support ring, seating means on each support element for engaging at least one of said satellite tubes to locate and support said satellite tubes on said rotary tube, and abutment means on said rotary tube and said support elements for detachably mounting said ring on said rotary tube, said abutment means being engageable with each other to limit said continuous support ring in circumferential and axial movement relative to said rotary tube.

2. The invention defined in claim 1 wherein said abutment means comprises a plurality of circumferentially spaced axially extending tabs fixedly mounted on the periphery of said rotary tube, and a plurality of axially extending radial projections on the radially inner surface of each of said support members adapted to project radially inwardly between adjacent tabs on said rotary member to establish end limits of circumferential movement of said support ring relative to said rotary tube.

3. The invention defined in claim 2 wherein said abutment means further comprises wedge means engageable between said projections and said tabs for locating said support ring in fixed circumferential relationship to said rotary tube.

4. The invention defined in claim 2 wherein said abutment means further comprises limiting ring means fixedly mounted on said tabs and in engagement with axially opposite sides of said support ring to restrain said support ring against axial movement relative to said rotary tube.

5. The invention defined in claim 1 wherein said securing means comprises bolt means detachably securing said support elements to each other.

6. The invention defined in claim 5 comprising flange means on said support elements receiving said bolt means.

7. The invention defined in claim 5 comprising flange means on each support element adapting to abut opposed flange means of an adjacent support element of said ring, said bolt means clamping flange means of adjacent support elements to each other.

8. The invention defined in claim 5 comprising coupling members secured by said bolt means to adjacent support members to couple the adjacent members to each other.

9. The invention defined in claim 1 wherein adjacent support elements when secured to each other in said ring abut each in a general plane extending radially from the axis of said rotary tube through the longitudinal centerline of a satellite cooling tube.

10. The invention defined in claim 1 wherein said seating means comprises a series of semi-circular recesses in said ring each adapted to receive a satellite tube, the general planes of abutment of adjacent support elements bisecting alternate ones of said recesses.

11. The invention defined in claim 1 wherein said seating means comprises a semi-circular recess in each support element adapted to receive a satellite cooling tube.

12. The invention defined in claim 11 wherein each of said support elements supports a single satellite tube.

13. The invention defined in claim 11 wherein each of said support elements supports a plurality of tubes.

14. The invention defined in claim 11 further comprising semi-circular holding means mounted on said support elements defining with said recesses circular openings receiving said satellite tubes.

15. The invention defined in claim 14 wherein said holding means receives said satellite tubes with a loose fit accommodating axial sliding movement of the satellite tube through the circular opening.

16. The invention defined in claim 14 wherein said holding means includes clamp means for fixedly clamping a satellite tube within said circular opening.

* * * * *